US007134401B2

(12) United States Patent
Debaes et al.

(10) Patent No.: US 7,134,401 B2
(45) Date of Patent: Nov. 14, 2006

(54) LANCET DEVICE FOR A FACE-TO-FACE WEAVING MACHINE AND FACE-TO-FACE WEAVING MACHINE PROVIDED WITH SUCH A LANCET DEVICE

(75) Inventors: Johny Debaes, Moorslede (BE); Jos Mertens, Kortrijk (BE)

(73) Assignee: N.V. Michel Van de Wiele, Kortrijk (BE)

( * ) Notice: Subject to any disclaimer, the term of this patent is extended or adjusted under 35 U.S.C. 154(b) by 53 days.

(21) Appl. No.: 10/966,027

(22) Filed: Oct. 18, 2004

(65) Prior Publication Data

US 2005/0109416 A1 May 26, 2005

(30) Foreign Application Priority Data

Oct. 17, 2003 (BE) ..... 2003/0544

(51) Int. Cl.
*D03S 39/16* (2006.01)

(52) U.S. Cl. ..... 116/21; 139/37; 139/102; 139/116.5

(58) Field of Classification Search ..... 139/21, 139/37, 102, 116.5
See application file for complete search history.

(56) References Cited

U.S. PATENT DOCUMENTS 3,289,706 A 12/1966 Valentine
5,154,208 A 10/1992 Carlos
6,176,270 B1 1/2001 Mettler
6,817,383 B1 * 11/2004 Debaes et al. ..... 139/21
6,837,274 B1 * 1/2005 Debaes et al. ..... 139/21
2003/0226613 A1 * 12/2003 Debaes et al. ..... 139/408
2004/0221915 A1 * 11/2004 Debaes et al. ..... 139/409
2005/0109416 A1 * 5/2005 Debaes et al. ..... 139/37
2005/0183787 A1 * 8/2005 Debaes ..... 139/11

FOREIGN PATENT DOCUMENTS

EP 0536551 4/1993
EP 1347087 9/2003

* cited by examiner

*Primary Examiner*—Gary Welch
*Assistant Examiner*—Andrew W. Sutton
(74) *Attorney, Agent, or Firm*—James Creighton Wray

(57) ABSTRACT

The invention relates to a lancet device for a face-to-face weaving machine (100), comprising one or several lancets (1,2,3;16), a lancet (1,2,3,16) at one extremity being provided to be installed in a lancet holder and at its other extremity being provided with a lancet tip (4*a*,4*b*), the lancets (1,2,3,16) being carried out in at least two embodiments, that are provided to be installed alternately next to one another in the face-to-face weaving machine, each of the two or several lancets (1,2,3,16) installed next to one another in the zone between the point where it is received in the lancet holder and the tip (4*a*,4*b*) of the lancet (1,2,3,16) on the opposite extremity of the lancet (1,2,3,16) being provided with one or several zones (C,D), that are not overlapping one another when the lancets (1,2,3,16) are projected in the weft direction. The invention furthermore relates to a face-to-face weaving machine that is equipped with a lancet device according to the invention.

14 Claims, 4 Drawing Sheets

LANCET DEVICE FOR A FACE-TO-FACE WEAVING MACHINE AND FACE-TO-FACE WEAVING MACHINE PROVIDED WITH SUCH A LANCET DEVICE

This application claims the benefit of Belgian Application No. 2003/0544 filed Oct. 17, 2003.

BACKGROUND OF THE INVENTION

The invention relates to a lancet device for a face-to-face weaving machine and furthermore to a face-to-face weaving machine provided with such a device.

When weaving face-to-face, two pile fabrics are woven at the same time. An upper and a lower backing fabric consisting of warp yarns and weft yarns, while pile warp yarns are interlaced in both backing fabric alternately. The parts of the pile warp yarns running between the two backing fabrics are cut through afterwards. In this manner, on each backing fabric a series of little ends of pile yarn standing upright are obtained. It is very important for the quality of the pile fabrics that the pile height all along the fabric is as constant as possible. As the intermediate distance between the upper and the lower fabric is determinant for the length of the parts of the pile warp yarns running between the two fabrics and therefore also for the pile height, this intermediate distance should be kept as constant as possible when weaving face-to-face. In order to obtain this, use is made of lancet devices on face-to-face weaving machines with two weft insertion levels. In doing so, a series of lancets is placed in a lancet holder evenly spread over the weft width and extending in the warp direction between the warp yarn systems and between the blades of the weaving reed. These lancets serve as spacers in order to keep the two backing fabrics at an intermediate distance from one another.

Known lancet devices for face-to-face weaving machines having two weft insertion levels are comprising lancets consisting of an elongated metal strip of a restricted thickness (for instance, 0.1, 0.2, 0.3 or 0.4 mm) and with a height being equal to the intermediate distance desired between the two backing fabrics in face-to-face weaving, for instance 3, 5, 8, 10, 15, 18, 20, 22, 24, 30 mm. One extremity is provided to be received by the lancet holder, while the other extremity is ending in a point, the point being situated above the lower cutting table of the weaving machine. The pointed tip may be made so as to be stepped symmetrically. When the so-called stepped lancets are shifted in the warp direction the lancet will take up another height near the reed and so it is possible to realize various pile heights with the same lancet device (and so the same lancet device enables us to realize different heights). When using such stepped lancets, the lancet height corresponds with the height of the topmost step. When high lancets are used, the various shed forming elements have to shift the warp yarns over greater heights, irrespective of the lancet height that has been adjusted or, in other words, irrespective of the pile height that has been adjusted. This is at the expense of weaving speed and weaving efficiency.

Other applications are known with greater lancet heights, for instance up to 70 and 90 mm in the form of spoon lancets, as represented in FIG. 10, where only at top level the full width is used and thereafter a smaller width is chosen in order to reduce the distance between the 2 rapiers to reduce the shed to be made.

Sometimes lancets with the usual heights up to 30 mm are also locally carried out with a constriction heightwise in order to draw the rapiers nearer to one another and to reduce the shed.

In weaving face-to-face fabrics, there is a distinct tendency to realize higher densities (a reed density of 500 or densities corresponding to a reed density of 700 or more) in combination with more colors. This leads to an increase of the number of warp yarns per meter of weaving width and the available space for the warp yarns to cross is restricted. These problems are still compounded by the presence of elements like healds with heald eyes (both for backing warp yarns and pile warp yarns), blades for the weaving reed and lancets as spacers. The same problems apply with lower densities when using thicker yarns.

To make crossing of the warp yarns (backing and pile warp yarns) less troublesome, various solutions are known.

It is known to take duplex healds as healds for the backing warp yarns, in order to solve the problem that the heald eyes may be getting so close together at high densities of the warp yarns, that a crossing of the remaining backing warp yarns and pile warp yarns may lead to friction, damage, fraying, rupture or getting stuck of these yarns. The healds being provided in two embodiments, being used alternately next to one another in a weaving frame, and the heald eyes of the first healds being situated in a row, in weaving direction after the row that is constituted by the second row of heald eyes. In this manner, more space is available near the healds of the backing warp yarns for the pile and backing warp yarns to be crossed, by dividing the healds into 2 levels situated one behind the other.

In U.S. Pat. No. 6,176,270 such a solution is described, essentially in view of using thick warp yarns for weaving and where, moreover, the healds near the receiving eyes are made elastic in order to be more resistant to dynamic charges.

According to patent EP 651 083 it is also known to provide the blades of a weaving reed with a recess, the back part being shifted parallel and laterally in the weft direction with respect to the front part. According to the description of the invention, this will enable the back part to be used as a deflector heald and to prevent pile warp yarns of the same pile warp yarn system from getting tangled or to separate the backing warp yarns and the pile warp yarns within a same warp yarn system. However, such a weaving reed is in practice also used as a double reed, a complete warp yarn system being inserted between each front and adjacent back part of a reed dent. Because of the foremost and the back reed dent parts being shifted with respect to one another, the warp yarns have more space within a pile warp yarn system to find their way to the face-to-face fabric.

Furthermore, in EP 1 347 086, a solution is proposed near the weaving reed, where per physical reed dent, two pile warp yarn systems and two (partially) backing warp systems have been provided. This method also enables us to produce more space for the pile warp yarns near the weaving reed in order to find their way to the face-to-face fabric.

However, none of these solutions is offering a solution for face-to-face weaving with lancets in the zone of the harness where in each warp yarn system a lancet is extending and the heald eyes of the pile warp yarns have to move between the lancets where there are already a number of pile warp yarns and healds for pile warp yarns. In face-to-face weaving on double rapier weaving machines it often happens that at each pick almost half of the dead pile is in the center, which means that the corresponding heald eyes are possibly situated between the lancets. This will strongly restrict the space for the pile warp yarns for crossing. This leads to an accelerated wear of the healds. In order to render the weaving process somewhat feasible and reliable, the spring tension is increased in order to have more force to pass a heald with pile warp yarn through this bundle.

It is known, in weaving with higher densities of warp yarns, to insert a lancet in one reed dent and no lancet in the next reed dent alternately. However, this has the disadvantage that in the reed tooth with the lancet, the weft is well kept at a distance, whereas in the next reed dent without a lancet, the weft is drawn nearer the center because of the tension of the pile warp yarns, so that the fabric will show an unwanted ribbed aspect. This aspect is very pronounced with the 1/1 V-weave, where part of the pile forming pile warp yarns is pulling at the binding warp and because of which the pile burl has itself interlaced at another height than the next pile burl adjacent in the weft direction, being kept at a distance by a lancet and also at another height than the pile burl before or after in the warp direction being interlaced on a tension warp yarn.

SUMMARY OF THE INVENTION

The purpose of the invention is to provide a lancet device for a face-to-face weaving machine, whereby it is possible to weave fabrics with a high density and/or a large number of pile warp yarns and where the density of the available lancets as spacers may be increased proportionally.

This purpose is attained by providing a lancet device for a face-to-face weaving machine, the lancets being carried out in at least two embodiments alternately installed in the face-to-face weaving machine next to one another, and where each of two or more lancets inserted are lying next to one another in the zone between the place where they are received in the lancet holder and the tip of the lancet at the opposite extremity of the lancet is provided with one or several zones not overlapping one another when the lancets are projected in the weft direction.

On the one hand, this method has the advantage that in the zone(s) of two lancets situated next to one another, not overlapping one another when projected in the weft direction, the warp yarns together with the healds to be crossed have a width greater by the thickness of one lancet than when using normal lancets. On the other hand, there is no lancet in the upward direction at any level along a greater width (practically double the width), such that the warp yarns and the healds between two parallel similar lancets have a larger buffer capacity. This means that when warp yarns and their healds are moving, collisions between warp yarns and/or healds will occur as a consequence of the larger packet of warp yarns and healds lying next to one another, these yarns and/or healds may reduce the effects of such collisions (friction, rupture, entangling) by a small lateral motion. Furthermore, the lancets become more elastic because of the reduced height of the lancets, which means that it is easier for them to get settled to create space where it is needed, and afterwards will return to their normal position because of their elasticity and the tension in these warp yarns and healds.

In a preferred embodiment of a lancet device according to the invention, each lancet has a constriction near the said zone(s), such that the height of the said zone(s) is smaller than the height of the lancet.

In a preferred embodiment of a lancet device according to the invention, each lancet has a bend in a part of the said zone(s) or over the entire zone(s), such that the part of the said zone(s) or the entire said zone(s) are bent away opposite the point where the lancet holder receives the lancet and opposite the tip of the lancet.

Preferably, the tip of each lancet is stepped and the bend of the part of the said zone(s) or the entire zone(s) is carried out such that the part of the said zone(s) or the entire said zone(s) are bent off opposite the topmost step of the lancet.

In a first preferred embodiment of a lancet device according to the invention, the weaving machine is provided with a weaving reed and the extremity of the constriction or the bend in the weaving direction on the side of the tip of each lancet is provided before the stroke over which the weaving reed can move.

Providing the extremity of the constriction or the bend before the stroke over which the weaving reed can move has the advantage that the warp yarns do not have to change over from the zone with more space to the zone having less space under the influence of the force of the motion of the weaving reed. Therefore, the collision will not be compounded by the force of the weaving reed.

In another preferred embodiment of a lancet device according to the invention, the weaving machine is provided with a weaving reed, and the extremity of the constriction or the bend in the weaving direction on the side of the tip of each lancet is provided within the stroke over which the weaving reed can move.

Providing the extremity of the constriction or the bend within the stroke over which the weaving reed can move has the advantage that the warp yarns, before the warp yarns are getting crossed within the weaving reed and the reed dents, are hampered by the presence of the lancet over a more restricted height.

In a preferred embodiment of a lancet device according to the invention, the weaving machine is provided with a weaving reed with reed teeth, each lancet being provided in a different reed tooth.

Thereby it is possible to make the tip of the lancet less thick than the rest of the lancet.

This has the advantage that in the zone within the stroke over which the weaving reed can move more space will be available for the warp yarns.

Still more preferred, in addition, the zone of the reduced thickness of the lancet is extended to the entire stroke over which the weaving reed is moving across each lancet.

Preferably, the lancets of the lancet device according to the invention are carried out in two embodiments.

Preferably, these two embodiments are vertically symmetrical with respect to one another.

When these two lancet embodiments are carried out to be symmetrical with respect to a vertical line, two adjacent lancets may be carried out in the same manner, but may be installed in a different manner (rotated through 180° with respect to their horizontal longitudinal axis).

In a preferred embodiment of a lancet device according to the invention, the weaving machine is provided with a weaving reed having half the density, that is provided with reed dents in which one or several warp yarn systems are installed, a lancet according to the first embodiment and a lancet according to the second embodiment extending within each reed dent, and two warp yarn systems moving on within each reed dent, which are separated from one another by one of the two lancets.

Preferably, the lancet device according to the invention is used in a face-to-face weaving machine with two weft insertion levels.

BRIEF DESCRIPTION OF THE DRAWINGS

By means of reference numbers, reference is made in this description to the attached drawings where.

DETAILED DESCRIPTION OF THE PREFERRED EMBODIMENTS

Figure 1:
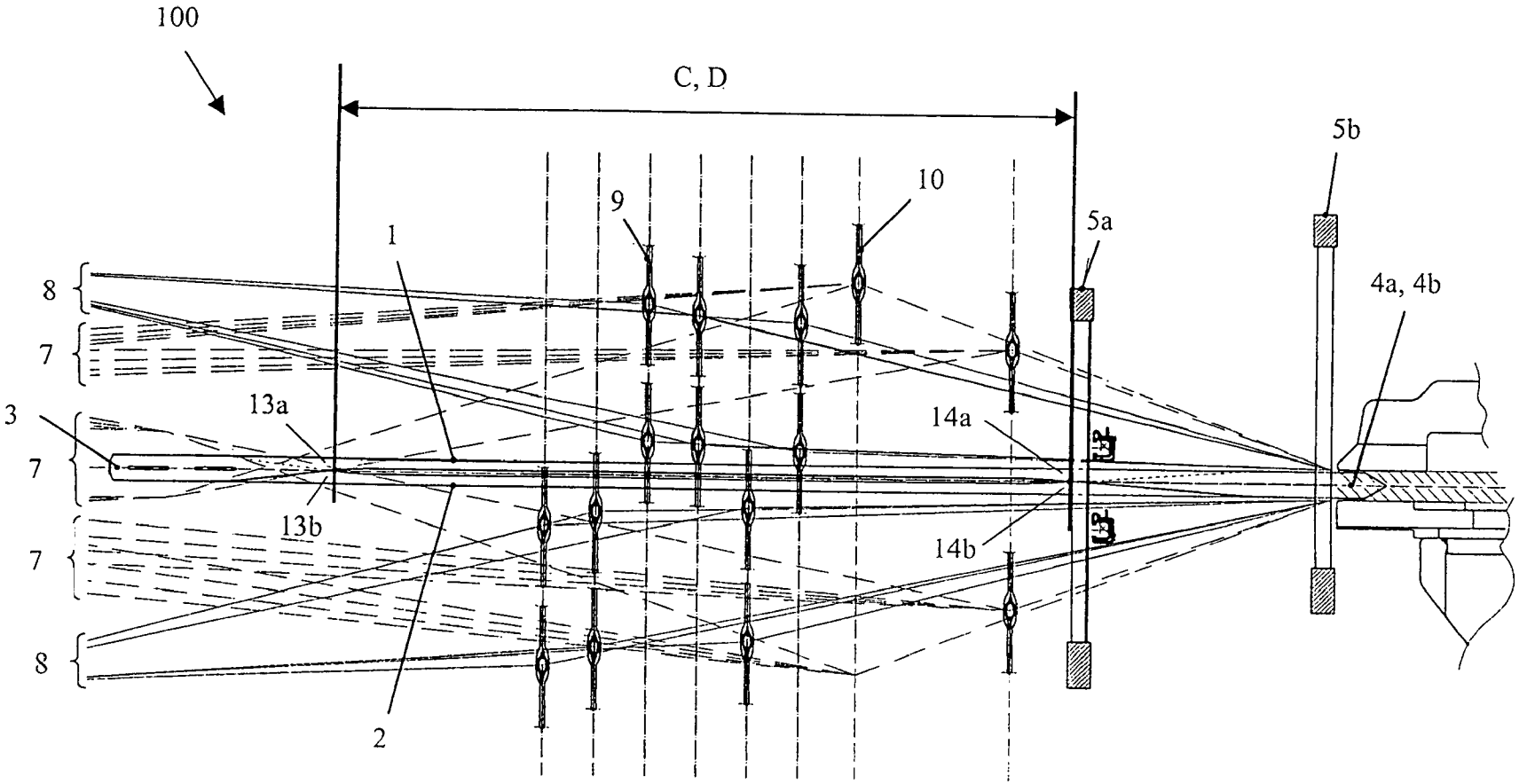
FIG. 1 is representing a cross-section of a face-to-face weaving machine with a first embodiment of a lancet device according to the invention, in which two adjacent lancets are provided according to the invention.
Figure 2:
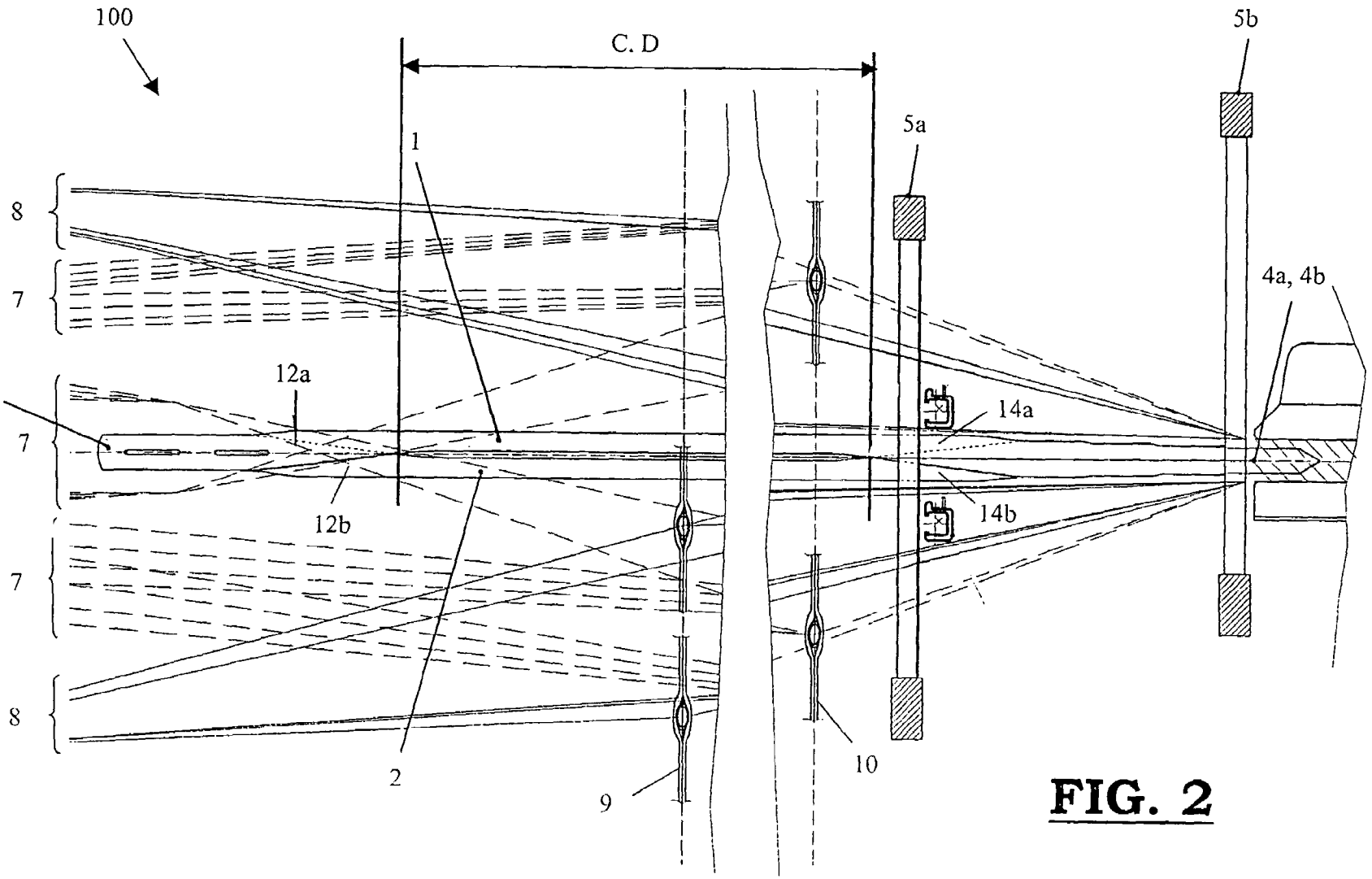
FIG. 2 is representing a cross-section of a face-to-face weaving machine with a second embodiment of a lancet device according to the invention.

In the FIGS. 1 and 2, a lancet device is represented that is provided on a face-to-face weaving machine with two weft insertion levels. In this lancet device according to the invention one or several lancets (1,2) are provided which are installed in a lancet holder (not represented in the figure) of a face-to-face weaving machine (100). The lancets (1,2) are carried out according to at least two different embodiments, being alternately installed in the face-to-face weaving machine (100) next to one another. In the FIGS. 1 and 2 a lancet device is represented, the lancets in the lancet device being carried out according to two embodiments. These two lancets (1,2) installed next to one another, in the zone between the point where they are received in the lancet holder (3) and the tip (4*a*,4*b*) of the lancet (1,2) at the opposite extremity of the lancet (1,2), are provided with one or several zones (C,D) not overlapping one another when being projected in the weft direction.

Figure 3A:
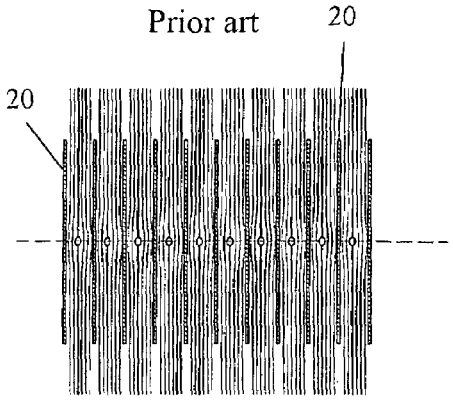
FIG. 3*a* is representing a cross-section at the level of the healds according to the state-of-the-art.
Figure 3B:
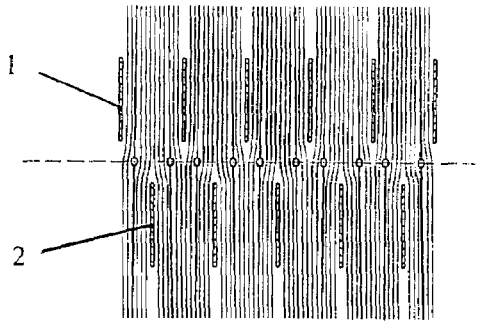
FIG. 3*b* is representing a cross-section at the level of the healds according to the invention.

On the one hand, this embodiment has the advantage that in the zones (C,D) of two adjacent lancets (1,2) not overlapping one another when being projected in the weft direction, the warp yarns (7,8) together with the healds (9,10), in order to enable them to be crossed, have at their disposal a width greater by the thickness of one lancet (1,2) than when normal lancets are being used. Preferably, the thickness of one lancet (1,2) here is situated between 0.3 and 0.5 mm. To that effect, the warp yarns (7,8) in their vertical motion, together with the healds (9,10), have to perform a short lateral motion. On the other hand, as represented in FIG. 3*b*, there is no lancet (1,2) at any level in the upward direction right across a greater width (practically double the width), such that the warp yarns (7,8) and the healds (9,10) have an increased buffer capacity between two parallel, similar lancets (1,2). That means that, when warp yarns (7,8) and their healds (9,10) are moving, mutual collisions between warp yarns (7,8) and/or healds (9,10) will occur because of the bigger packet of adjacent warp yarns (7,8) and healds (9,10), these yarns may reduce the effects of such collisions (friction, rupture, entangling) by a small lateral motion. On the other hand, according to the state-of-the-art, as represented in FIG. 3*a*, each lancet (20) extends across the entire height.

Furthermore, the reduced height of the lancets (1,2) will render these lancets (1,2) more elastic, what means that they may set themselves more easily in order to create more space where it is needed and they will return to their normal positions because of their elasticity and the tension of these warp yarns (7,8) and healds (9,10).

EXAMPLE

When using a reed of 500, 4 mm are available per two warp systems for two lancets (1,2) having a thickness of 0.3 mm and the various warp yarns from the two warp systems. With lancets (1,2) according to the invention, per two warp yarn systems, 4 mm are available, and only one lancet thickness of 0.3 mm is required for just as many warp yarns (7,8), creating an additional free space of 0.3 mm with respect to 3.4 mm. This means an increase of about 9%. This greater space will enable the spring tension on the healds (9,10) of the pile warp yarns (7,8) to be reduced and will slow down the wear and tear of the healds (9,10).

In FIG. 1, a lancet device is represented, in which each lancet (1,2) near one or several zone(s) (C,D) has a constriction (13*a*,13*b*), such that the height of the said zone(s) (C,D) is smaller than the height of the lancet (1,2).

In FIG. 2, these two embodiments are carried out to be vertically symmetrical with respect to one another. In view of this symmetry, two adjacent lancets (1,2) are of the same embodiment, but the lancets, are mounted in the lancet holder, turned through 180° with respect to a horizontal axis. For this reason, only one of the two lancets (1,2) will be discussed in the following paragraph for the construction of the lancets (1,2). The lancet (1,2), as represented in FIG. 2, has a bend (12*a*,12*b*) along the entire zone(s) (C,D), such that the entire said zone(s) (C,D) is bending off opposite the point where the lancet (1,2) is received by the lancet holder (3) and opposite the tip (4*a*,4*b*) of the lancet (1,2). However, also part of the said zone(s) (C,D) may be bending off opposite the point where the lancets are received by the lancet holder (3) and opposite the tip (4*a*,4*b*) of the lancets (1,2), which has not been represented in the figure.

When, as represented in FIG. 2, the tip (4*a*,4*b*) of the lancet (1,2) is of a stepped embodiment, the part of the said zone(s) or the entire said zone(s) will be bending off opposite the topmost step of the lancet (1,2). In addition, the invention has the advantage that the height of the lancet (1,2), with stepped lancets corresponding to the topmost step of the lancet (1,2), is no longer the same all along the entire length, and the lancets (1,2) are lighter and cheaper and may be better manipulated and they are less stiff, so that they will be more easy for them to adjust their position sideways in order to dampen or neutralize the effects of mutual collisions between warp yarns (7,8) or healds (9,10) or the effects of collisions between warp yarns (7,8) and healds (9,10).

The zone where the constriction (13*a*,13*b*) or the bend (12*a*, 12*b*) ends, (i.e. in order to proceed again to a complete overlapping of two adjacent lancets (1,2) (when projected in the weft direction), may occur in the weaving direction both before the stroke over which the weaving reed (5*a*,5*b*) can move, i.e. as represented in the FIGS. 1 and 2, and within the stroke over which the weaving reed (5*a*,5*b*) can move, i.e. between the positions 5*a* and 5*b* (which has not been represented in the figures).

Providing the extremity (14*a*,14*b*) of the constriction (13*a*,13*b*) or bend (12*a*,12*b*) on the side of the tip (4*a*,4*b*) of each lancet (1,2) before the stroke over which the weaving reed (5*a*,5*b*) can move has the advantage that, under the influence of the force exerted by the motion of the weaving reed (5*a*,5*b*), the warp yarns (7,8) do not have to pass from the zone with more space for the warp yarns 57,8) to the zone with less space. Thus, the collision is not compounded by the force of the weaving reed.

Providing the extremity (14*a*,14*b*) of the constriction (13*a*,13*b*) or bend (12*a*,12*b*) on the side of the tip (4*a*,4*b*) of each lancet (1,2) within the stroke over which the weaving reed can move (5*a*,5*b*) has the advantage that the warp yarns (7,8), before the warp yarns (7,8) are crossing within the weaving reed (5*a*,5*b*) and the reed dent, are hampered by the presence of the lancet (1,2), for a more restricted height.

The tip (4*a*,4*b*) may be carried out in another, preferably a more reduced thickness than the rest of the lancet (1,2) in order to offer more space for the warp yarns (7,8) in that zone. This zone of the lancet having a reduced thickness may be extended to the entire stroke over within which the weaving reed (5*a*,5*b*) is moving, i.e. between 5*a* and 5*b* and which has not been represented in the figures.

Figure 4A:
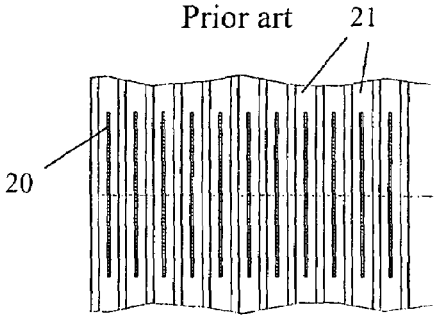
FIG. 4*a* is representing a cross-section through the weaving reed according to the state-of-the-art, the lancets being represented opposite the reed dents.
Figure 4B:
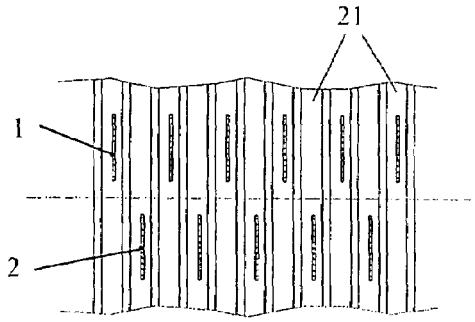
FIG. 4*b* is representing a cross-section through the weaving reed according to the invention, the lancets being represented opposite the reed dents.

Each lancet (1,2) according to the invention, may extend through a different reed dent (21), as represented in FIG. 4*b*. According to the state-of-the-art represented in FIG. 4*a*, also one lancet (20) is extending per reed dent (21), however for double the height.

Figure 5:
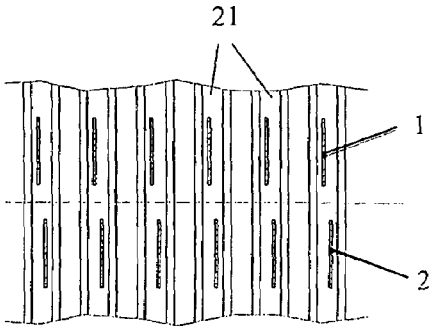
FIG. 5 is representing a cross-section through the weaving reed, two lancets per reed dent being provided, which is used with high density fabrics.

However, as represented in FIG. 5, a weaving reed (5*a*,5*b*) of half the density with respect to the number of warp systems may also be used for high densities, a lancet (1) of the first type and a lancet (2) of the second type (2) extending within each reed dent (21), and two warp yarn systems moving along within each reed dent, separated from one another by the two lancets (1,2). This embodiment has the advantage, that the warp yarns (7,8), widthwise per warp system, will get more space to the amount of the width of one reed dent (21), and moreover, the lancets (1,2) within the doubled reed dent (21) will be able to move sideways in order to favor the passage and the crossing of warp yarns (7,8).

Figure 6:
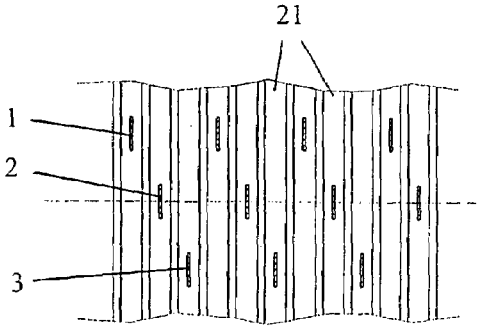
FIG. 6 is representing a cross-section of the weaving reed, the lancets being carried out according to three variants.

As already mentioned above, the lancets (1,2,3), as represented in FIG. 6, may be carried out in more than two embodiments (for instance in three embodiments), certain zones of adjacent lancets (1,2,3) not overlapping one another when projected in the weft direction. The lancets (1,2,3) are carried out as described above.

Figure 7A:
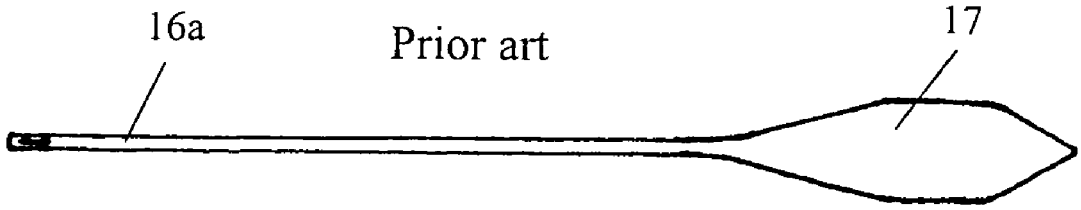
FIG. 7*a* is representing a spoon lancet according to the state-of-the-art.
Figure 7B:
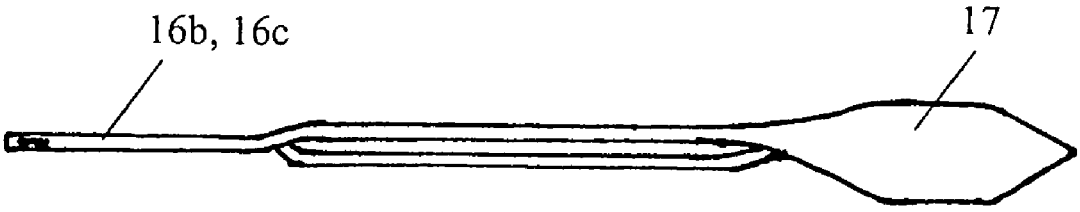
FIG. 7*b* is representing a spoon lancet according to the invention.

When greater lancet heights are used, then the lancets are carried out in the form of spoon lancets (16), as represented in the FIGS. 7*a* and 7*b*. With spoon lancets (16), the full width is only used near the tip (17) and thereafter, a smaller width is used, in order thus to reduce the distance between the two rapiers of the face-to-face weaving machine (100), in order to reduce the shed to be made. The spoon lancets (16*a*), according to the state-of-the-art, are adapted according to the invention, what leads to spoon lancets (16*b*,16*c*), as represented in FIG. 7*b*. Such an adapted lancet device therefore also has the advantages of the invention when used with higher densities.

The invention claimed is:

1. Lancet device for a face-to-face weaving machine, comprising one or several lancets, a lancet being provided at one extremity to be mounted in a lancet holder and the other extremity being provided with a lancet tip, wherein the lancets are carried out in at least two embodiments, that are provided to be mounted alternately on a face-to-face weaving machine next to one another in a weft direction, each one of two or several lancets installed next to one another in the weft direction in the zone between the point where they are received by the lancet holder and the tip of the lancet, at the opposite extremity of the lancet being provided with one or several zones (C,D) not overlapping one another, when the lancets are projected in the weft direction.

2. Lancet device according to claim 1, wherein each lancet has a constriction near the said zone(s) (C,D), such that the height of the said zone(s) is smaller than the height of the lancet.

3. Lancet device according to claim 2, wherein the face-to-face weaving machine is provided with a weaving reed, and the extremity of the restriction or the bend on the side of the tip of the lancet in the weft direction, is provided before the stroke over which the weaving reed can move.

4. Lancet device according to claim 2, wherein the face-to-face weaving machine is provided with a weaving reed, and the extremity of the restriction or the bend on the side of the tip of the lancet in the weft direction, is provided within the stroke over which the weaving reed can move.

5. Lancet device according to claim 1, wherein each lancet, along a part of the said zone(s) (C,D) or through the entire said zone(s) (C,D), has a bend, such that part of the said zone(s) (C,D) or the entire said zone(s) (C,D), will be bending off opposite the point where the lancet (C,D) is received in the lancet holder and opposite the tip of the lancet (C,D).

6. Lancet device according to claim 5, wherein the tip of each lancet is stepped and in that the bend of part of the said zone(s) (C,D) or the entire said zone(s) (C,D) has been carried out such, that the part of the said zone(s) (C,D) or the entire said zone(s) (C,D) are bending off opposite the topmost step of the lancet.

7. Lancet device according to claim 1, wherein the face-to-face weaving machine is provided with a weaving reed with reed dents, each lancet being provided in a different reed dent.

8. Lancet device according to claim 7, wherein the tip of the lancet has a smaller thickness than the rest of the lancet.

9. Lancet device according to claim 8, wherein the zone with the reduced lancet thickness is extended to the entire zone in which the weaving reed is moving over each lancet.

10. Lancet device according to claim 1, wherein the lancets are made in two embodiments.

11. Lancet device according to claim 10, wherein the two embodiments are lengthwise symmetrical with respect to one another.

12. Lancet device according to claim 10, wherein the face-to-face weaving machine is provided with a weaving reed of half the density, that is provided with reed dents in which one or several warp yarn systems are applied, a lancet of the first embodiment and a lancet of the second embodiment extending within each reed dent, and two warp systems moving along within each reed dent that are separated from one another by one of the two lancets.

13. Lancet device according to claim 1, wherein the lancet device is applied to a face-to-face weaving machine with two weft insertion levels.

14. Face-to-face weaving machine equipped with a lancet device according to claim 1.

* * * * *